United States Patent [19]

Lewis

[11] 4,408,748

[45] Oct. 11, 1983

[54] INTEGRAL FENCE POST AND CAP

[75] Inventor: Philip C. Lewis, Houston, Tex.

[73] Assignee: Southwestern Pipe, Inc., Houston, Tex.

[21] Appl. No.: 392,880

[22] Filed: Jun. 28, 1982

[51] Int. Cl.[3] ..... E04H 17/06

[52] U.S. Cl. ..... 256/11; 256/65

[58] Field of Search ..... 256/11, 12, 3, 2, 65, 256/21, DIG. 5; 403/237, 235, 234, 241, 242

[56] References Cited

U.S. PATENT DOCUMENTS

| | | | |
|---|---|---|---|
| 1,773,519 | 8/1930 | Cox | 256/11 |
| 1,839,898 | 1/1932 | Skinner | 256/11 |
| 2,351,261 | 6/1944 | Hall | 189/23 |
| 3,285,576 | 11/1966 | Clark | 256/21 |
| 3,698,691 | 10/1972 | Brown | 256/11 |
| 3,749,368 | 7/1973 | Miller | 256/11 |
| 3,972,639 | 8/1976 | Lening | 403/235 X |
| 4,037,788 | 7/1977 | Riley | 239/207 |

FOREIGN PATENT DOCUMENTS

| | | | |
|---|---|---|---|
| 995018 | 8/1951 | France | 403/237 |
| 13066 | of 1909 | United Kingdom | 403/237 |

*Primary Examiner*—Andrew V. Kundrat

*Attorney, Agent, or Firm*—Lahive & Cockfield

[57] ABSTRACT

A tubular fence post has a U-shaped cut-out portion to receive a top rail, the upward extension of the fence post walls being bendable over the top rail to secure it. In a second embodiment, one of the upward extensions forms a barb arm that attains a diagonal orientation when bent over the top rail. A shorter upward extension opposite the barb arm has a lock tab bendable over side tabs of the barb arm.

7 Claims, 5 Drawing Figures

INTEGRAL FENCE POST AND CAP

This invention relates generally to fence posts and particularly to fence posts with integral caps for securing top rails to the posts.

BACKGROUND

Fences with top rails, used for chain link fences, for example, usually include posts, inserted into the ground or secured to footings, and caps, secured to the tops of the posts. The caps are used to secure a horizontal top rail to complete the framework of the fence. The fabric of the fence is then attached to the fence framework. Some fences are topped with barbed wire for security, and in such cases, the caps include an upwardly extending barb arm. The barb arm extends diagonally and horizontally strands of barbed wire are secured to the arm.

The improvements to such fences that have been devised have as their objects security and ease of manufacture and assembly. The vast quantity of posts and caps that are necessary to construct a fence make cost reduction in their manufacture desirable. Furthermore, fences are typically constructed on site and the ease with which the fence can be assembled is also an important factor. The fewer tools that are needed for assembly, and the fewer parts that must be stockpiled, the better. More parts mean that matching numbers of parts must be available and that assembly will be required of even sub-assemblies. Special tools may be required, or special fittings may have to be incorporated as part of the sub-assemblies.

The typical chain link fence framework includes tubular posts and separate pieces, called loop caps, that are added to the posts in the field. Usually the loop caps are cast or pressed from steel or aluminum, and are secured to the tops of the posts. The top rail of the fence runs through these fittings. The prior art shows some fence posts in which a top rail securing portion is integral with the fence post. U.S. Pat. Nos. 3,285,576 (Clark) and 4,037,788 (Riley) show such posts. The disclosures of both patents show upside down U-shaped posts in which the top rail is inserted through the base of the U. In the case of U.S. Pat. No. 3,285,576, the post is tubular, with the portion at the base of the U flattened to form a defined hole through which the top rail slides. In both cases, the cap formed by the top of the post is a portion that completely encircles the top rail.

Some variations of the basic barb arm described earlier, that have appeared in the prior art, include a hinged loop cap shown in U.S. Pat. No. 3,749,388 (Miller), that is hinged so that the barb arm may be pivoted for removal of the top rail. A variation shown in the same patent shows a loop cap without a barb arm that is also hinged for removal of the top rail. Another patent, U.S. Pat. No. 1,773,519 (Cox) shows an adjustable barb arm post top that is pivotable about the axis of the top rail and lockable in a number of positions. Both these devices are separate post tops meant to be installed in the traditional way on top of posts already in position. Another patent, U.S. Pat. No. 2,351,261 (Hall) shows a fence post with an integral barb arm, but that fence post is for use without a top rail, however.

The object of this invention is to provide an inexpensive and easily manufactured one piece fence post and cap to which top rails can be secured in the field securely and easily. The integral cap and post of the invention has no elaborate fittings and machined components. Another object is to provide an integral fence post and cap in which the cap serves as an integral barb arm.

BRIEF DESCRIPTION OF THE DRAWINGS

Other objects, features and advantages of the invention will be pointed out or will be seen to be inherent in the following descriptions of two preferred embodiments of the invention, including the drawings thereof, in which.

DESCRIPTION OF THE PREFERRED EMBODIMENTS

Figure 1:
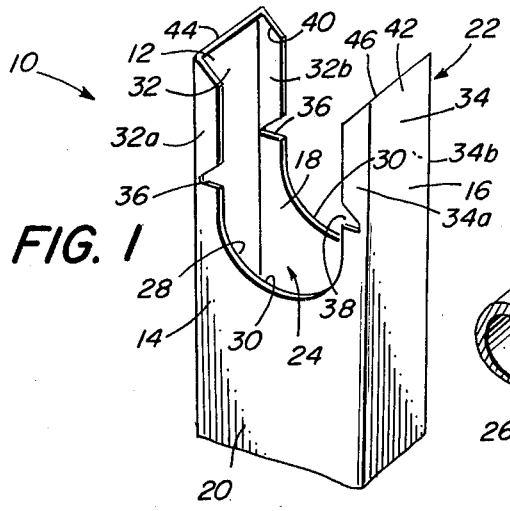
FIG. 1 is a perspective view of the upper portion of a fence post embodying the invention, before the top rail is dropped in place.
Figure 2:
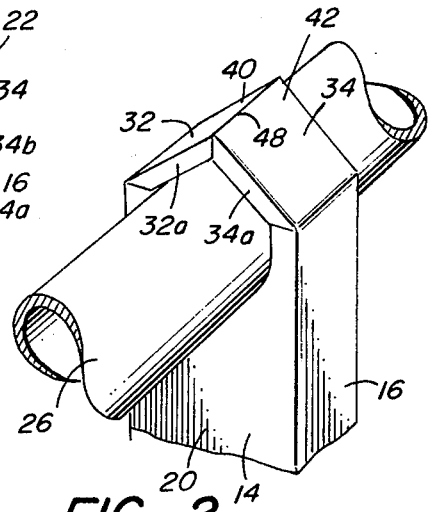
FIG. 2 is a similar perspective view with a top rail in place and a top portion of the fence post bent over the top rail to secure it in position.

The first embodiment of the invention is shown in FIGS. 1 and 2. A fence post 10 is of tubular construction, made of four straight walls 12, 14, 16 and 18 so that the post 10 is substantially rectangular in cross-section, this configuration being preferred because it has a high bending strength per unit weight. The material preferably used is rolled steel, though other materials such as aluminum could be used. The configuration of the tube, once formed, can be left with an open seam or the seam can be welded. Alternatively, the fence post 10 can be cut from tubular stock formed from any variety of methods.

The bottom portion of the fence post 10, not shown, is conventional. The tubular main section 20 continues down to a base suitable for driving into the earth or insertion into a footing or attachment to a fitting.

Referring now to the top portion 22, or cap portion, of the fence post 10, that portion 22 has a top rail recess 24 for receiving a cylindrical top rail 26. A U-shaped cut-out 28 in opposing walls 14, 18 of the fence post 10 forms semicircular top rail support edges 30 on which the top rail 26 can be laid. The top rail support edges 30 could be of other configurations suitable for other top rails. A top rail with a rectangular cross-section, for example, would require a horizontal, straight, support edge.

On either side of the cut-out 28, the fence post walls 12, 16 continue upward beyond the rail recess 24 to form rail enclosing wall portions 32, 34. Each wall portion 32, 34 has short side walls 32*a*, *b* and 34*a*, *b* extending inwardly toward the top rail recess 24. Notches 36, 38 are cut out in the side walls 32*a*, *b* and 34*a*, *b* just above the recess 24 to facilitate the inward bending of the rail enclosing wall portions 32, 34. The tops 40, 42 of the rail enclosing wall portions 32, 34 are bevelled, so that as the rail enclosing wall portions 32, 34 are bent toward each other the top edges 44, 46 of the rail enclosing wall portions 32, 34 can meet.

To form a fence framework with these fence posts 10, the posts 10 are first secured to the ground in whatever conventional way is suitable. The cut-outs 28 are oriented so that a top rail 26 can be laid down in the recesses 24 of a succession of posts 20. The rail enclosing wall portions 32, 34 are then hammered inwardly to enclose the rail 26 between them. The notches 36, 38 in the walls 32*a, b* and 34*a, b* allow the bending to occur. The bevelled cut at the tops 40, 42 of the rail enclosing wall portions 32, 34 allow the wall portions to meet at a neat line 48, providing a secure enclosure for the top rail 26.

Figure 3:
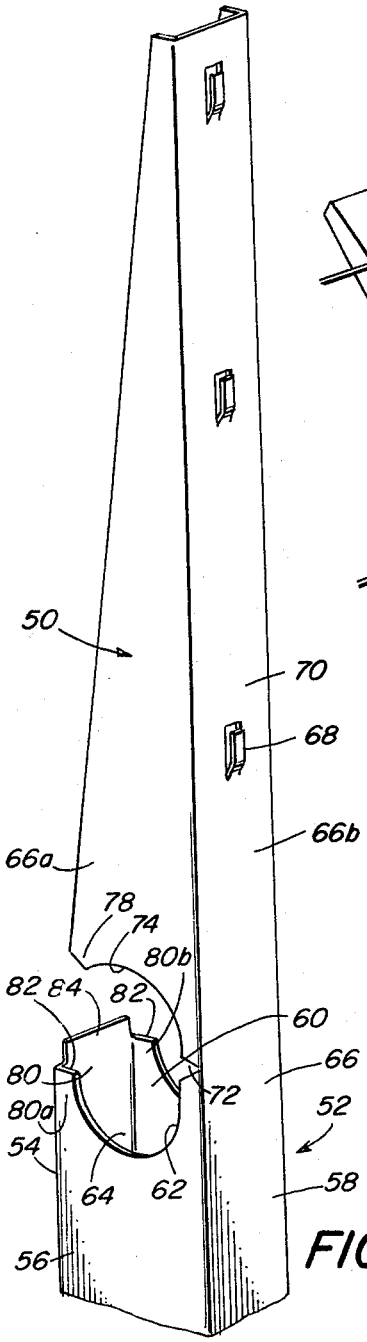
FIG. 3 is a perspective view of a top portion of another fence post embodying the invention, in which the top portion forms a barb arm.
Figure 4:
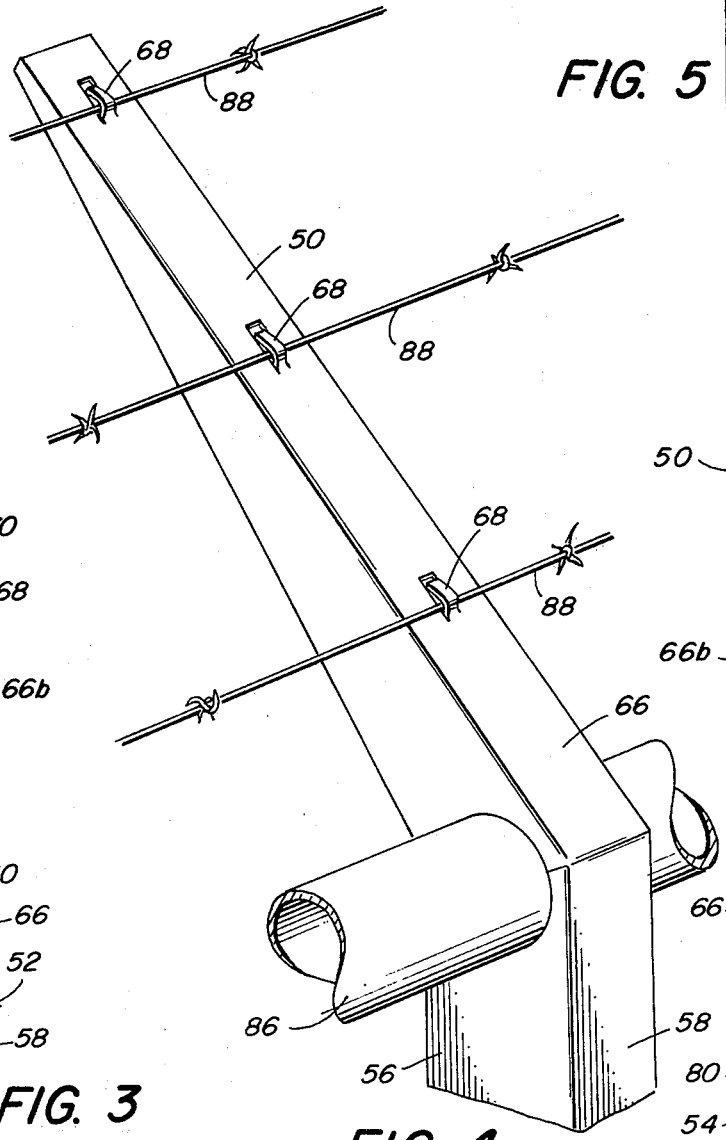
FIG. 4 is a view like that of FIG. 3, showing the top portion secured over a top rail and strands of barbed wire secured to the barb arm.
Figure 5:
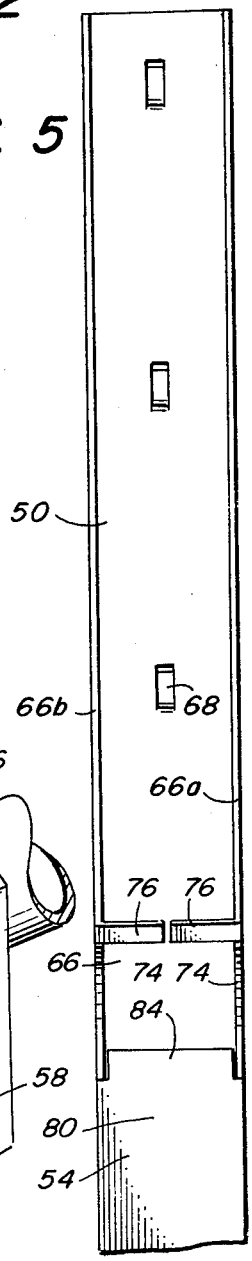
FIG. 5 is an elevation view of the top portion of the second embodiment, showing the locking tab and side tabs of the top portion.

FIGS. 3, 4 and 5 show a second embodiment of the invention in which a barb arm 50 is an integral part of the fence post 52. In this second embodiment, the fence post 52 is similar to the first in that a tubular configuration for the fence post 52 consists of four straight walls 54, 56, 58, 60 extending downwardly to some conventional bottom configuration for attachment to the ground.

The fence post 52 of the second embodiment also has U-shaped cut-outs 62 in opposing walls 56, 60 to form a top rail receiving recess 64. As shown in FIG. 3, one rail enclosing wall portion 66 extends upwardly to form the barb arm 50, with a number of wire securing clips 68 on the outside 70 of the wall portion 66. The wall portion 66 has side walls 66*a, b* extending inwardly, and notches 72 cut into the side walls 66*a, b* just above the rail recess 64 so that the wall portion 66 can be bent inwardly.

A portion of each side wall 66*a, b* of the rail enclosing wall portion 66 above the rail recess is also cut out to form bottom rail enclosing edges 74. Furthermore, side tabs 76 (see FIG. 5) are located at the corners 78 of the inside bottom edges 74 of the wall portion side walls 66*a, b*. The side tabs 76 extend toward each other.

A shorter rail enclosing wall portion 80 opposite the first rail enclosing wall portion 66 extends above the rail recess 64 to a point beneath the corners 78 of the barb arm wall portion side walls 66*a, b*. The shorter rail enclosing wall portion 80 has inwardly extending side walls 80*a, b*, but no notches because in the second embodiment the shorter wall portion 80 is not adapted to be bent inwardly. Instead the shorter rail enclosing wall portion 80 extends a short distance upwardly beyond the tops 82 of its side walls 80*a, b* to form a locking tab 84.

To form a fence framework and a diagonal barb arm with the fence post 52 of the second embodiment, several fence posts 52 are first secured to the ground. Then a top rail 86 is dropped into the rail recesses 64 of a succession of posts 52. The barb arm 50 is then hammered inwardly to enclose the rail 86, the result being that the barb arm 50 is then oriented diagonally to the fence post 52 (see FIG. 4) in the usual orientation of barb arms. In the bent position of the barb arm 50, the side tabs 76 of the rail enclosing portion 66 are moved to near the locking tab 84 of the shorter rail enclosing wall portion 80. The locking tab 84 is hammered to bend over the side tabs 76 to secure them and the barb arm 50 in the rail enclosing position. Then strands 88 of barbed wire (see FIG. 5) may be secured to the clips 68 of the barb arm 50.

ADVANTAGES OF THE INVENTION AND UNOBVIOUSNESS OVER THE PRIOR ART

The integral fence post and cap of the invention provides a device that is easy and inexpensive to manufacture from readily available stock. There are no machined or cast fittings to add to the cost and complexity of the fence post.

While the cap is integral to the fence post, the invention still allows the cap to be manipulated to secure the top rail. U.S. Pat. Nos. such as 3,285,576 (Clark) and 4,037,788 (Riley) mentioned in the Background show fence posts in which there is no separate cap, but the caps are not manipulated or movable to secure the top rail. The top rail is instead slid through circular apertures at the tops of the fence posts. The fence post of the invention instead provides a recess into which the top rail can be dropped and then secured.

In the barb arm embodiment of the invention, the ease of using the integral fence post and cap is also impressive. Straight stock is turned into a diagonal barb arm at the same time the top rail is secured. U.S. Pat. Nos. such as 3,749,368 (Miller) and 1,773,519 (Cox) also mentioned in the Background show pivotable and hinged barb arms, but those arrangements require hinges and then securing devices and fittings such as the machined latches in Miller and the fittings in Cox. The U.S. Pat. No. to Hall (2,351,261) (see the Background) shows a barb arm integral with a post, in which the barb arm is bent by clinching the sides of the post with a clinching tool. However, the Hall barb arm differs structurally and functionally from the arrangement of the invention and does not involve a top rail securing function.

The two embodiments described above show that modifications and variations of the invention are possible. Such modifications and variations are within the scope of the invention, however, that scope being defined by the following claims.

I claim:

1. An integral fence post and cap comprising a vertical post means having vertical walls defining a polygonal, horizontal cross section and providing planar side walls, an upper portion of said post means defining a top rail receiving recess into which a horizontal top rail can be dropped, at least one of said vertical walls extending vertically above said top rail receiving recess to form a rail enclosing portion having a polygonal cross section, said rail enclosing portion being adapted to be bendable over said top rail to secure it in said recess, said at least one vertical wall which extends above said top rail receiving recess defining a planar, coextensive continuation of a vertical wall of said post means, said polygonal cross section of said rail enclosing portion defining, when bent over said rail, an angled coextensive continuation of a portion of said polygonal horizontal cross section of said post means, and said rail enclosing portion defining, when bent over said top rail, a flat cap top means extending at least partially across the top of said top rail.

2. The fence post and cap structure of claim 1 wherein at least two of said vertical walls extend vertically above said top rail receiving recess, on opposite sides of said recess, to form oppositely facing rail enclosing portions, said two oppositely facing rail enclosing portions being adapted to be bendable toward each other over said top rail to secure said top rail in said recess.

3. The fence post and cap structure of claim 1 wherein said rail enclosing portion comprises an outside wall portion, side wall portions extending inwardly toward said recess from the edges of said outside wall portion, and notches cut in said side wall portions above said top rail receiving recess for allowing said rail enclosing portion to be bendable over said top rail.

4. The fence post and cap structure of claim 1 wherein said rail enclosing portion comprises an extension adapted to secure strands of wire, said rail enclosing portion being adapted to be bendable over said top rail to secure it in said recess, and to orient said extension in a direction diagonal to said vertical post means.

5. An integral fence post and cap comprising a vertical post means having vertical walls, an upper portion of said post means defining a top rail receiving recess into which a horizontal top rail can be dropped, at least one of said vertical walls extending vertically above said top rail receiving recess to form a rail enclosing portion, said rail enclosing portion being adapted to be bendable over said top rail to secure it in said recess;

said rail enclosing portion comprising an extension adapted to secure strands of wire, said rail enclosing portion being adapted to be bendable over said top rail to secure it in said recess, and to orient said extension in a direction diagonal to said vertical post means, and said vertical walls further comprising an upright wall extending above said rail receiving recess, opposite said rail enclosing portion, adapted to lockingly engage said rail enclosing portion after said rail enclosing portion is bent over said top rail.

6. The fence post and cap structure of claim 5 wherein said rail enclosing portion includes side tab means located above said top rail receiving portion, and said upright wall terminates in a locking tab bendable over said side tab means after said rail enclosing portion is bent over said top rail.

7. A fence post and cap structure comprising a tubular vertical post means, having vertical circumferential walls defining a polygonal, horizontal cross section and providing planar side walls, an upper portion of said tubular vertical post means (defining) having a U-shaped cut-out portion defining at the bottom of said cut-out portion a top rail receiving recess, an upper portion of said vertical circumferential walls comprising a rail enclosing wall means having a polygonal cross section extending above said rail receiving recess, said rail enclosing walls means having a polygonal cross section being adapted to be bendable over and directly engageable with said top rail to secure it in said recess, and said rail enclosing wall means defining planar side wall portions which are coplanar with said planar side walls of said post means.

* * * * *